US005993100A

United States Patent [19]

Gastmann

[11] Patent Number: 5,993,100

[45] Date of Patent: Nov. 30, 1999

[54] CURTAIN-RAIL CONNECTOR

[75] Inventor: Günter Gastmann, Essen, Germany

[73] Assignee: Cedargrove Limited, Gibraltar

[21] Appl. No.: 09/207,243

[22] Filed: Dec. 8, 1998

[30] Foreign Application Priority Data

Dec. 17, 1997 [DE] Germany ..... 197 55 828

[51] Int. Cl.[6] ..... F16B 7/00

[52] U.S. Cl. ..... 403/292; 160/345; 403/301

[58] Field of Search ..... 160/123, 124, 160/126, 330, 345; 403/292, 294, 293, 300, 301, 286, 14

[56] References Cited

U.S. PATENT DOCUMENTS

| | | | |
|---|---|---|---|
| 1,904,588 | 4/1933 | Weinberg | 160/126 X |
| 3,587,131 | 6/1971 | Graf | 16/95 R |
| 5,518,058 | 5/1996 | Gastmann | 160/330 |

*Primary Examiner*—Harry C. Kim
*Assistant Examiner*—David E. Bochna
*Attorney, Agent, or Firm*—Herbert Dubno; Andrew Wilford

[57] ABSTRACT

A connector is used with a pair of hollow rails having longitudinally confronting ends and each forming a downwardly open longitudinal slot and having a pair of upwardly directed support faces flanking the slot. A hanger has a head longitudinally displaceable inside the rails on the support faces thereof, a body projecting through the slot downward out of the rails, and a horizontally projecting guide flange immediately below the rails and at a predetermined spacing below the head. The hanger is adapted to carry a curtain below the rails. The connector has a flat, vertical, and transversely extending body plate between the rail ends and a pair of flat guides fixed to the body plate below the rail ends, extending between and longitudinally overlapping the rail ends, and each having a generally horizontally extending upper face engageable with the guide flange on sliding of the hanger between the rails and subdivided into a downwardly inclined end region extending at a small acute angle to the support faces and a center region substantially parallel to the support faces. The guides are transversely spaced and separated by a longitudinally extending gap directly below the slot having a widened end. The center regions of the upper faces are spaced below the support surfaces by a distance shorter than the spacing between the guide flange and the head such that as the guide flange rides up the end region the head is lifted up off the support faces.

9 Claims, 3 Drawing Sheets

FIG. 4
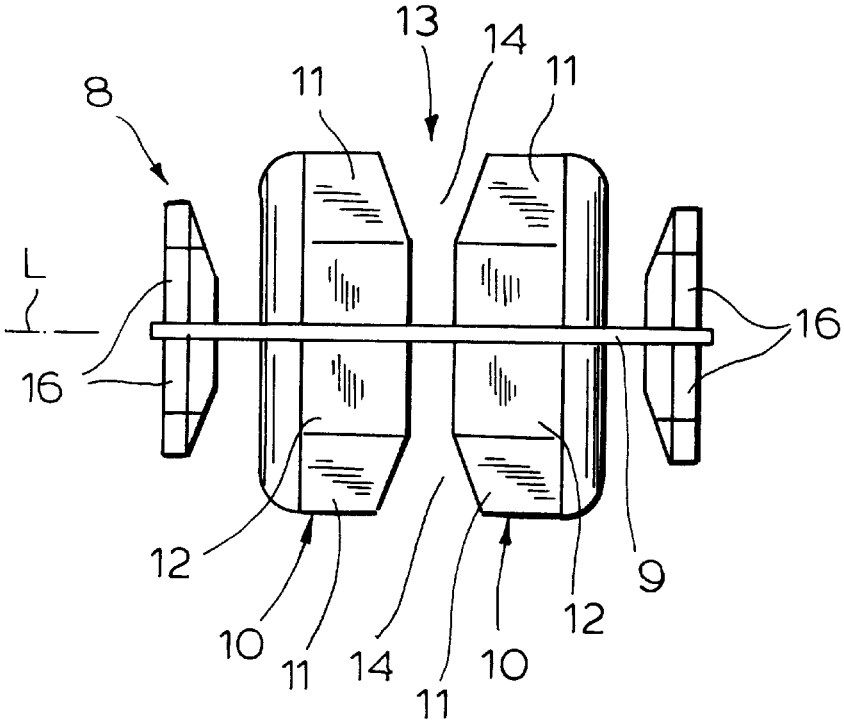
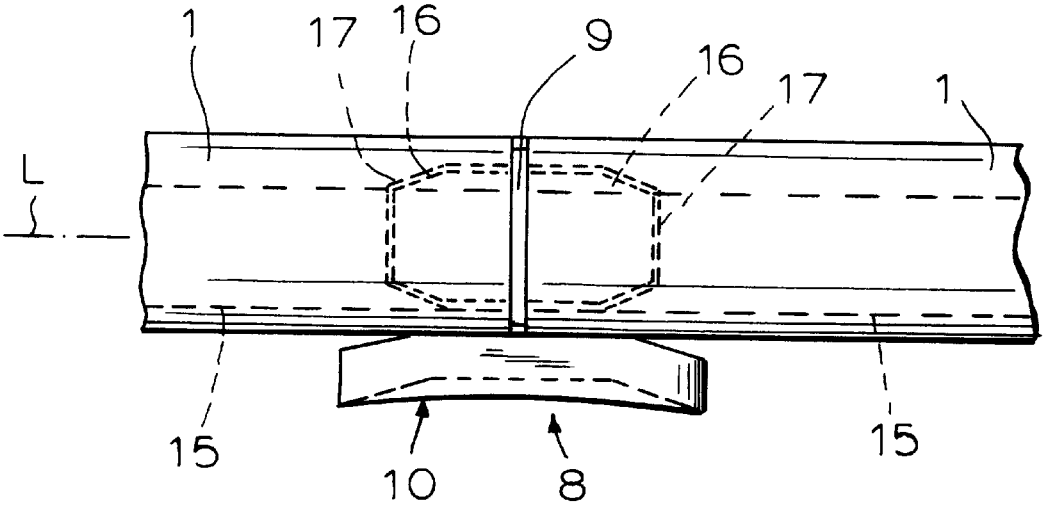
FIG. 8

CURTAIN-RAIL CONNECTOR

FIELD OF THE INVENTION

The present invention relates to a curtain-rail connector. More particularly this invention concerns such a connector used with a hollow curtain rail in which move curtain-supporting hangers.

BACKGROUND OF THE INVENTION

It is standard to mount curtains on hangers that slide in overhead-mounted guide rails. The longitudinally extending guide rails form a downwardly open and longitudinally extending slot and each rail has a pair of longitudinally extending upwardly directed support faces flanking the slot. The hangers each have a head longitudinally displaceable inside the rails on the support faces thereof, a body projecting through the slot downward out of the rails, and a horizontally projecting guide flange immediately below the rails and at a predetermined spacing below the head. The curtain is normally suspended from loops on the lower ends of the hangers. Thus it is possible to open and close the curtains by sliding the hangers along the rails. Since the hangers are guided inside the rails, the installation is very neat and can blend into any decor.

The main problem with these systems is in the transition from rail to rail. Ideally it is merely necessary to butt the rails and secure them solidly so that the joints between rail ends is closed and the hangers do not catch on them. If, however, there is any vertical or horizontal misalignment, or if the rails are not perfectly aligned, the hangers can catch at a joint, making the installation inoperative.

OBJECTS OF THE INVENTION

It is therefore an object of the present invention to provide an improved connector for a hollow-rail curtain-mount assembly.

Another object is the provision of such an improved connector for a hollow-rail curtain-mount assembly which overcomes the above-given disadvantages, that is which ensures smooth travel of the hangers between adjacent rails.

SUMMARY OF THE INVENTION

The instant invention is a connector used in combination with a pair of hollow longitudinally extending guide rails having longitudinally confronting ends. Each rail forms a downwardly open and longitudinally extending slot and has a pair of longitudinally extending upwardly directed support faces flanking the slot. A hanger has a head longitudinally displaceable inside the rails on the support faces thereof, a body projecting through the slot downward out of the rails, and a horizontally projecting guide flange immediately below the rails and at a predetermined spacing below the head. The hanger is adapted to carry a curtain below the rails. In accordance with the invention the connector has a flat, vertical, and transversely extending body plate between the rail ends and a pair of flat guides fixed to the body plate below the rail ends, extending between and longitudinally overlapping the rail ends, and each having a generally horizontally extending upper face engageable with the guide flange on sliding of the hanger between the rails and subdivided into a downwardly inclined end region extending at a small acute angle to the support faces and a center region substantially parallel to the support faces. The guides are transversely spaced and separated by a longitudinally extending gap directly below the slot having a widened end.

The center regions of the upper faces are spaced below the support surfaces by a distance shorter than the spacing between the guide flange and the head such that as the guide flange rides up the end region the head is lifted up off the support faces. Formations secure the body plate between the rail ends.

Thus this connector in effect makes the hangers jump over the ends of the rails. Even if these ends are not perfectly aligned, one being higher than the other for instance, the hanger will be raised and will pass over the uneven joint, supported on the guides of the hanger. The connector can also have an angle built in, that is be centered on a curved line, to form corner connectors for the curtain rail. These connectors can be combined with rails of any desired length, even ones cut on the site for particular conditions, and of any desired shape so that custom installations are very easy and the problem of the curtain hangers getting caught as they pass from rail to rail is completely eliminated.

In the connector according to the invention the body plate is formed with tabs projecting longitudinally into the rail ends. The rail ends are formed with seats complementary to the tabs. This ensures a solid connection.

The connector further has connecting webs between the guides and the plate and the guides have confronting inner edges that flare apart at at least one longitudinal end, normally at opposite longitudinal ends. Thus the connector can also compensate for any minor horizontal misalignment of the rails it joins.

These guides in accordance with the invention have downwardly concave lower faces. Furthermore the connector is unitarily formed of one piece of plastic.

According to another feature of the invention each rail forms a downwardly open and longitudinally extending slot of predetermined width and the connector forms a longitudinally extending gap directly below the slot and having a width narrower than the slot width. This slot is formed by confronting inner edges that flare apart at at least one longitudinal end.

BRIEF DESCRIPTION OF THE DRAWING

The above and other objects, features, and advantages will become more readily apparent from the following description, reference being made to the accompanying drawing in which:

FIG. 4 is a top view taken in the direction of arrow IV of FIG. 1;

FIG. 8 is a side view of a connector between a pair of guide rails according to the invention.

SPECIFIC DESCRIPTION

Figure 1:
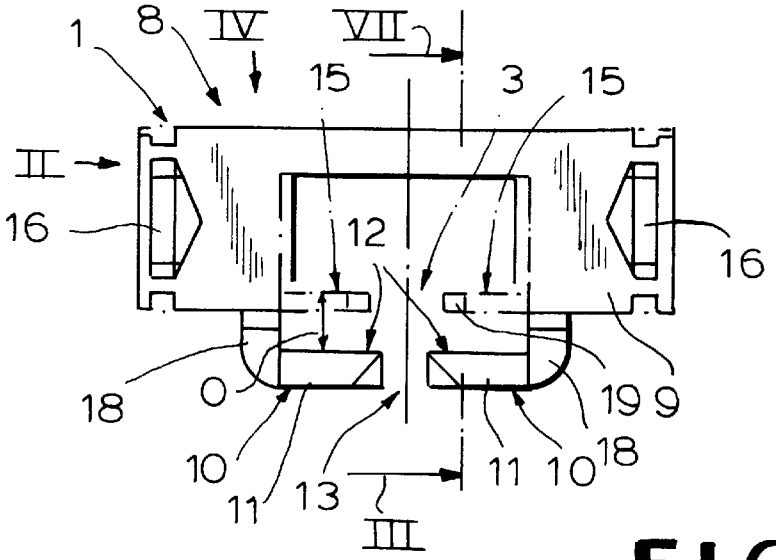
FIG. 1 is an end view of the connector according to the invention.
Figure 2:
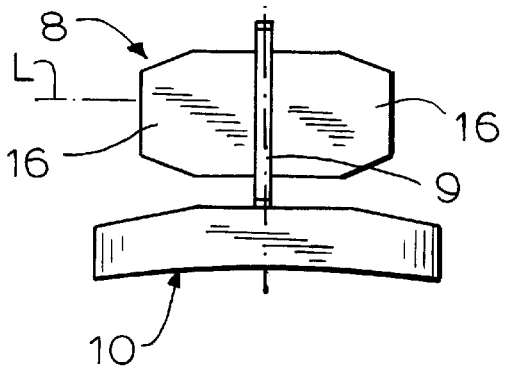
FIG. 2 is a side view taken in the direction of arrow II of FIG. 1.
Figure 3:
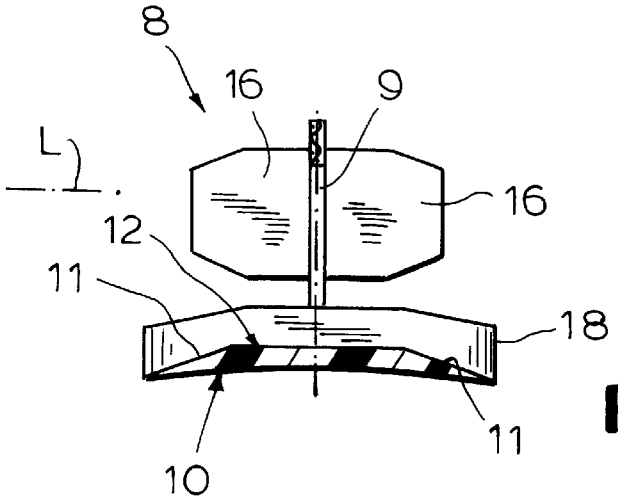
FIG. 3 is a section taken along line III—III of FIG. 1.
Figure 5:
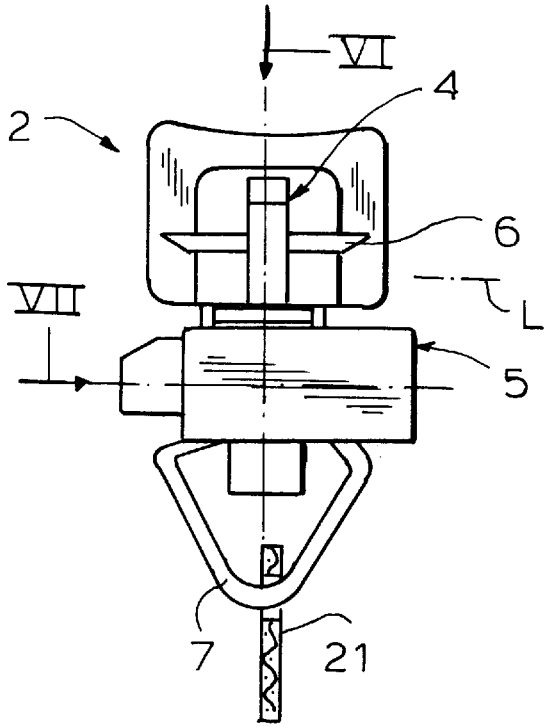
FIG. 5 is a side view of the hanger used in the system of this invention.
Figure 6:
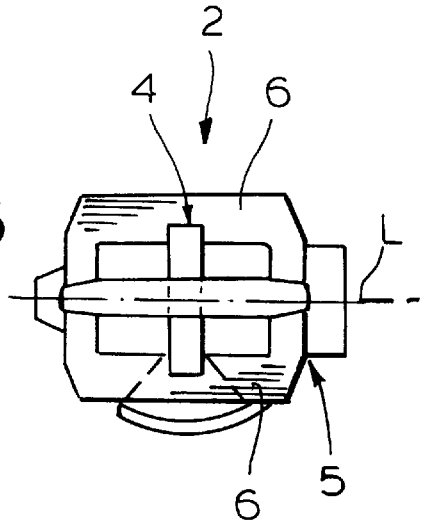
FIG. 6 is a top view taken in the direction of arrow VI of FIG. 5.
Figure 7:
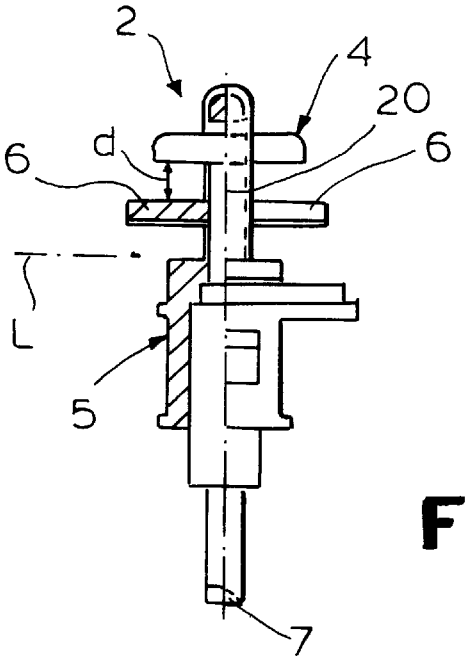
FIG. 7 is a partly sectional side view taken in the direction of arrow VII of FIG. 5.

As seen in the drawing, the instant invention is aimed at a connector 8 (FIGS. 1–4) intended to interconnect ends of a pair of curtain-guide rails 1 (FIGS. 1 and 8) along which slide a plurality of hangers (FIGS. 5–7) from which is suspended a curtain 21.

The rails 1 are normally made of metal or plastic and extend in a normally horizontal longitudinal direction L. They are hollow and form a downwardly open slot 3 and a pair of upwardly directed support surfaces 15.

Each hanger 2 is formed of one piece of plastic and has, as generally described in commonly owned patent U.S. Pat. No. 5,518,058, a body 20 provided at its upper end with a T-shaped head 4 that normally rides on the surfaces 15 and, set therebelow at a spacing d, a transversely projecting guide flange 6 that is normally situated below the rails 1. A carriage 5 is provided below the flange 6 and below it is a hanger loop 7 that passes through an eyelet of the curtain 21. A plurality of such hangers 2 is normally employed, spaced apart in the direction L, to carry the curtain 21. This structure is standard.

According to the invention the connector 8 has a plate-like body 9 of downwardly open U-shape that is fitted between the ends of the rails 1 and that extends perpendicular to the direction L. It is formed on each of its longitudinally directed faces at its outer ends with longitudinally projecting mounting tabs 16 that engage in complementary seats 17 (FIG. 8) of the rails 1 to secure the body plate 9 solidly in place between the rail ends. If the opposite faces of the body 9 are not parallel, the connector can be used to form a corner.

The connector body 9 carries a pair of bridge guides 10 by means of connecting webs 18. Each such guide 10 is basically flat with a downwardly concave lower face and lies in a horizontal plane, with run-up end surfaces 11 and a horizontal center surface 12, the latter at a spacing D below the support faces 15. The guides 10 are separated by a space 13 somewhat narrower than the slot 3 but wide enough to allow the body 20 to pass between them. The space 13 has longitudinally flared ends 14 whose width at their outermost part is equal to or slightly greater than that of the slot 3. Similarly the ends of the slot 3 are flared at 19 to ease entry of the hangers 2 into them.

Thus as each hanger 2 moves from one rail 1 to the next, it will be briefly supported by the guides 10 engaging the under side of the flange 6 since the dimension d is smaller than the dimension D. The faces 11 and 12 of the guides are spaced below the support faces 15 of the rails that, as the flange 6 engages the one run-up surface, the hanger 2 is lifted to raise its head 4 off the faces 15. Thus as the hanger 2 passes between the rails 1 it is supported on the guides 11. As the flange 6 rides down on the opposite run-out surface 12, the head 4 is set back down on the faces 15 for normal movement. When the head 4 has rollers that ride on the faces 15 this operation can be the same, although normally the rollers used are of great enough diameter that they can bridge any minor gap between adjacent rail ends.

I claim:

1. In combination:

a pair of hollow longitudinally extending guide rails having longitudinally confronting ends, each rail forming a downwardly open and longitudinally extending slot and having a pair of longitudinally extending upwardly directed support faces flanking the slot; and a hanger having a head longitudinally displaceable inside the rails on the support faces thereof, a body projecting through the slot downward out of the rails, and a horizontally projecting guide flange immediately below the rails and at a predetermined spacing below the head, the hanger being adapted to carry a curtain below the rails; and a connector comprising:

a transversely extending body plate between the rail ends;

a pair of guides fixed to the body plate below the rail ends, extending between and longitudinally overlapping the rail ends, and each having a generally horizontally extending upper face engageable with the guide flange on sliding of the hanger between the rails and subdivided into a downwardly inclined end region extending at a small acute angle to the support faces and a center region substantially parallel to the support faces, the guides being transversely spaced to define directly below the slot a longitudinally extending gap having a widened end, the center regions of the upper faces being spaced below the support surfaces by a distance shorter than the spacing between the guide flange and the head such that as the guide flange rides up the end region the head is lifted up off the support faces; and formations securing the body plate between the rail ends.

2. The combination defined in claim 1 wherein the body plate is formed with tabs projecting longitudinally into the rail ends.

3. The combination defined in claim 2 wherein the rail ends are formed with seats complementary to the tabs.

4. The combination defined in claim 1 wherein the connector further has connecting webs between the guides and the plate.

5. The combination defined in claim 1 wherein the guides have confronting inner edges that flare apart at at least one longitudinal end.

6. The combination defined in claim 1 wherein the guides have confronting inner edges that flare apart at opposite longitudinal ends.

7. The combination defined in claim 1 wherein the guides have downwardly concave lower faces.

8. The combination defined in claim 1 wherein the connector is unitarily formed of one piece of plastic.

9. In combination:

a pair of hollow longitudinally extending guide rails having longitudinally confronting ends, each rail forming a downwardly open and longitudinally extending slot of predetermined width and having a pair of longitudinally extending upwardly directed support faces flanking the slot;

a hanger having a head longitudinally displaceable inside the rails on the support faces thereof, a body projecting through the slot downward out of the rails, and a horizontally projecting guide flange immediately below the rails and at a predetermined spacing below the head, the hanger being adapted to carry a curtain below the rails; and a connector engaged between the rail ends and forming a longitudinally extending gap directly below the slot and having a width, the gas width being narrower than the slot width and increasing at at least one longitudinal end of the slot.

* * * * *